United States Patent [19]

Burns

[11] Patent Number: 4,877,089

[45] Date of Patent: Oct. 31, 1989

[54] METHOD AND APPARATUS FOR COUPLING WIRELINE TOOLS TO COIL TUBING

[75] Inventor: Robert W. Burns, Richmond, Tex.

[73] Assignee: Western Atlas International, Inc., Houston, Tex.

[21] Appl. No.: 63,420

[22] Filed: Jun. 18, 1987

[51] Int. Cl.[4] ..... E21B 47/00

[52] U.S. Cl. ..... 166/377; 166/65.1; 166/117; 166/242; 166/378; 285/2; 285/334.5

[58] Field of Search ..... 166/65.1, 77, 77.5, 166/377, 378, 385, 376, 50, 117, 178, 242, 301, 380; 175/318, 320; 339/191-195; 403/74, 2; 285/1, 2, 33-35, 382.4, 81, 304, 309, 314, 382.5, 382.7, 3, 4; 294/86.17, 86.18

[56] References Cited

U.S. PATENT DOCUMENTS

| | | | |
|---|---|---|---|
| 579,986 | 4/1897 | Jordan | 285/334.5 X |
| 2,332,354 | 10/1943 | Stecher | 285/334.5 X |
| 3,089,551 | 5/1963 | Greene | 175/318 |
| 3,401,749 | 9/1968 | Daniel | 166/77 X |
| 3,446,297 | 5/1969 | Cullen et al. | 175/320 X |
| 4,082,144 | 4/1978 | Marquis | 166/250 |
| 4,457,370 | 7/1984 | Wittrisch | 166/250 |
| 4,612,984 | 9/1986 | Crawford | 166/77 |
| 4,648,444 | 8/1987 | Busch | 166/65.1 |
| 4,682,657 | 7/1987 | Crawford | 166/385 |
| 4,685,516 | 8/1987 | Smith et al. | 166/65.1 |
| 4,706,744 | 11/1987 | Smith et al. | 166/65.1 |
| 4,759,406 | 7/1988 | Smith et al. | 166/55.1 |

*Primary Examiner*—Hoang C. Dang

*Attorney, Agent, or Firm*—Patrick H. McCollum; Barry C. Kane

[57] ABSTRACT

Apparatus for coupling wireline tools to coil tubing wherein a pull-out, disconnect, is provided. The pull-out consists of two tubular members with flared, bell-shaped portions, one such portion being coaxially disposed within the other. A ferrule applies pressure to the interface of the surfaces of said flared portions. Sufficient tension on the coil tubing pulls the flared portion of the interior member through the neck and out of the exterior member. Pilot valves prevent intrusion of bore hole fluid into the coupling device during logging and into the coil tubing if a pull-out has been effected.

16 Claims, 5 Drawing Sheets

METHOD AND APPARATUS FOR COUPLING WIRELINE TOOLS TO COIL TUBING

BACKGROUND OF THE INVENTION

This invention relates generally to methods and apparatus for running wireline tools on coil tubing and, more specifically, to methods and apparatus for coupling wireline tools to coil tubing.

It is common practice to drill wells in exploration for oil and gas with a portion of the bore deviating from vertical orientation. The deviation or inclination may extend for a considerable distance, sometimes returning to the usual vertical orientation. It is well known in the art of drilling such wells to attempt to log or perforate the formations surrounding such boreholes with instruments run into the well bore on an electrical wireline to perform various operations. Such tools usually depend upon the force of gravity to become positioned within the well bore.

Manifestly, the relatively horizontal angle of the deviated portion of the well bore will not permit the wireline conveyed tools to move into and through the deviated portion since friction of the tool on the deviated portion works against the force of gravity. In the past, numerous specialized methods and devices for assisting the wireline conveyed tools through deviated portions of a well bore have been suggested. Examples of such devices are illustrated in U.S. Pat. Nos. 4,457,370, showing a system for running a tool coupled directly to a string of drill pipe; 4,082,144, illustrating a mechanical device attached to the tool to assist descent; and 3,401,749, describing a system of running a tool coupled to a relatively flexible conduit, commonly referred to as "coil tubing".

A typical logging or perforation operation using coil tubing includes a system where an electric wireline is inserted through a length of conduit and connected to a tool at the distal end of the conduit. The tool, wireline and conduit are extended into the well bore by winding the conduit from a coil tubing unit located at the earth's surface. An example of one method for coupling a tool to the tubing can be found in U.S. Pat. No. 4,612,984, which is incorporated herein by reference.

An inherent problem when running any tool in a well is that it may become stuck. The presence of sand or other debris is just one of several causes of such difficulty, and the problem is especially critical in a deviated well. The "pull-out" devices presently known in the art do not furnish an adequate solution to such problem; however, as those devices are directed primarily to tools attached only to a wireline and lowered thereon into the well by means of gravity. An example of such a device is found in U.S. Pat. No. 4,648,444. Devices such as the aforesaid, for use with a gravity-feed wireline, allow separation of the wireline (or cable) and cable head from the tool through the exertion of tension on the cable from the earth's surface. Once the cable and cable head are removed from the well, a fishing tool is lowered into the well for the purpose of securely grasping, and hopefully, dislodging the jammed logging tool.

Such wireline pull-outs are not, however, particularly useful in connection with coil tubing deployed in a deviated hole and/or in logging operations where the well is flowing during logging. If the well is flowing during logging, it is desirable to attach coil tubing to a logging tool in a fluid tight, occlusive manner. Otherwise, temporary increases, or "spikes", of pressure in the bore hole can send damaging fluid up into the coil tubing. Consequently, use of a typical wireline pull-out with coil tubing conveyed tools is inappropriate because merely effecting separation of the tubing from the tool would allow the intrusion of bore hole fluids into the coil tubing, an event which frequently negates much of the advantage in using coil tubing in the first place.

One feature of this invention is, therefore, to provide methods and apparatus for connecting a wireline tool to coil tubing in such manner that the connection is fluid occlusive and the interior of the tubing is protected from pressure spikes, but that the tool can be surely and conveniently separated from the tubing should the tool become stuck downhole; and another of the several features of this invention is to provide methods and apparatus for such separation which preserves the integrity of the tubing and prevents the intrusion of bore hole fluids therein.

SUMMARY OF THE INVENTION

Methods and apparatus are provided for connecting a wireline tool to coil tubing. Attached below the coil tubing is a flow control sub, a tubular member containing a pilot valve therein. Attached below the flow control sub is a release sub. At its lower end, the release sub flares into a bell shape forming thereon a skirt, and such skirt is coaxially disposed within a locking sub, the interior wall of which is beveled to form a chamfer of complimentary shape. Attached below the locking sub is a cable head body, and attached below the cable head body is the tool. The cable head body contains flow ports allowing fluid communication between the interior of cable head body and the bore hole of the well, and pilot valves retained in the flow ports allow emission of fluid from the cable head body but prevent fluid entry therein from the bore hole. Electrical conductors pass down through the wireline, and out the end of the coil tubing, and run the length of the coupling device to an electrical connection with the tool.

A neck on the locking sub prevents the skirt of the release sub from being pulled out of or withdrawn from locking sub except with the application of a predetermined pulling force or tension on the portion of release sub not disposed within locking sub. A ferrule inside the skirt of release sub compresses the skirt against the chamfer of locking sub. A nut tightens down against the ferrule which allows variation in the extent to which ferrule compresses the skirt against the chamfer.

BRIEF DESCRIPTION OF THE DRAWINGS

A more complete understanding of the present invention will be obtained by reading the following detailed description thereof in conjunction with the accompanying drawings, wherein like reference characters denote like parts in all views, and wherein.

DESCRIPTION OF THE PREFERRED EMBODIMENT

Figure 1:
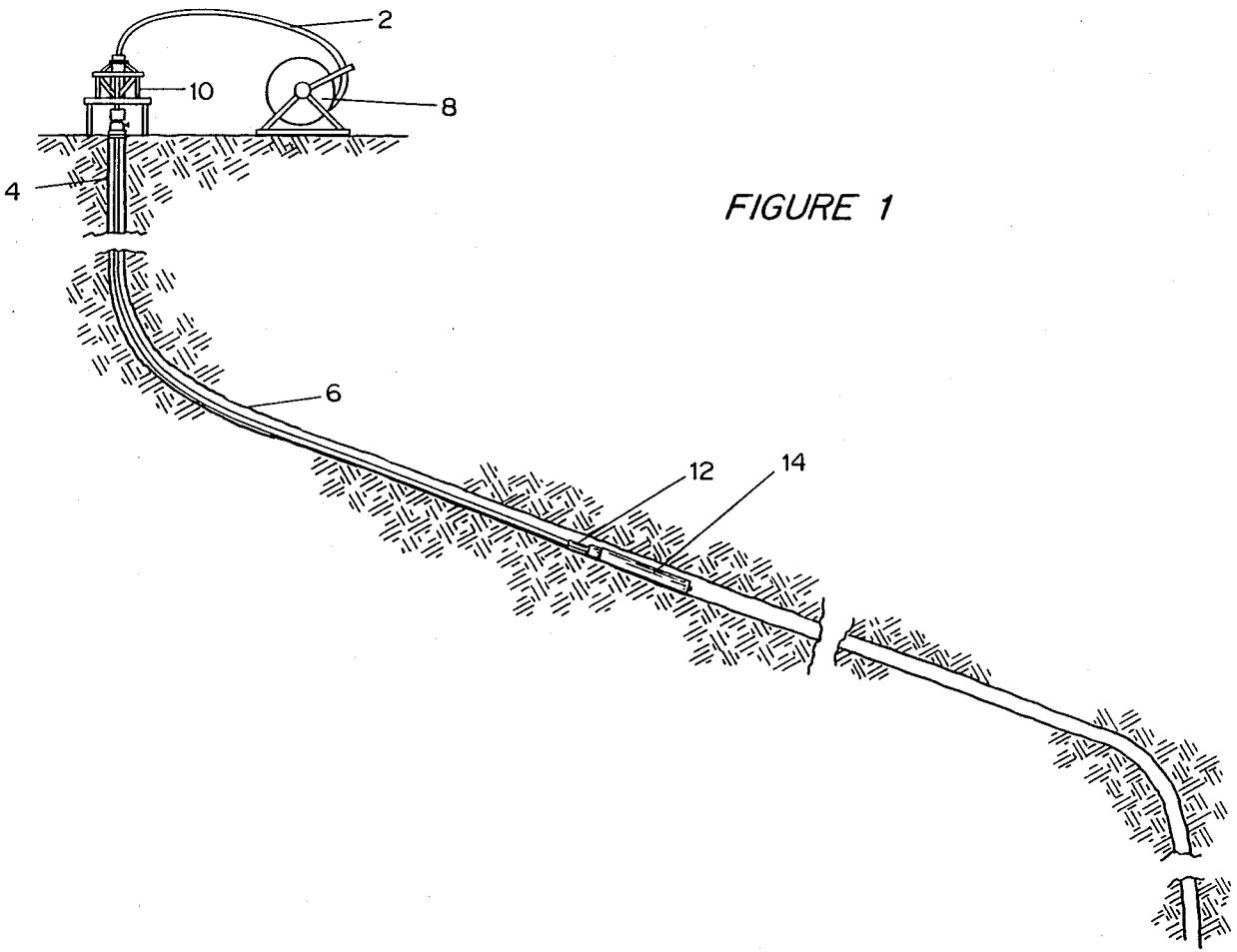
FIG. 1 is a schematic view illustrating a well bore having a deviated portion, with coil tubing and apparatus constructed in accordance with this invention disposed therein.
Figure 2A:
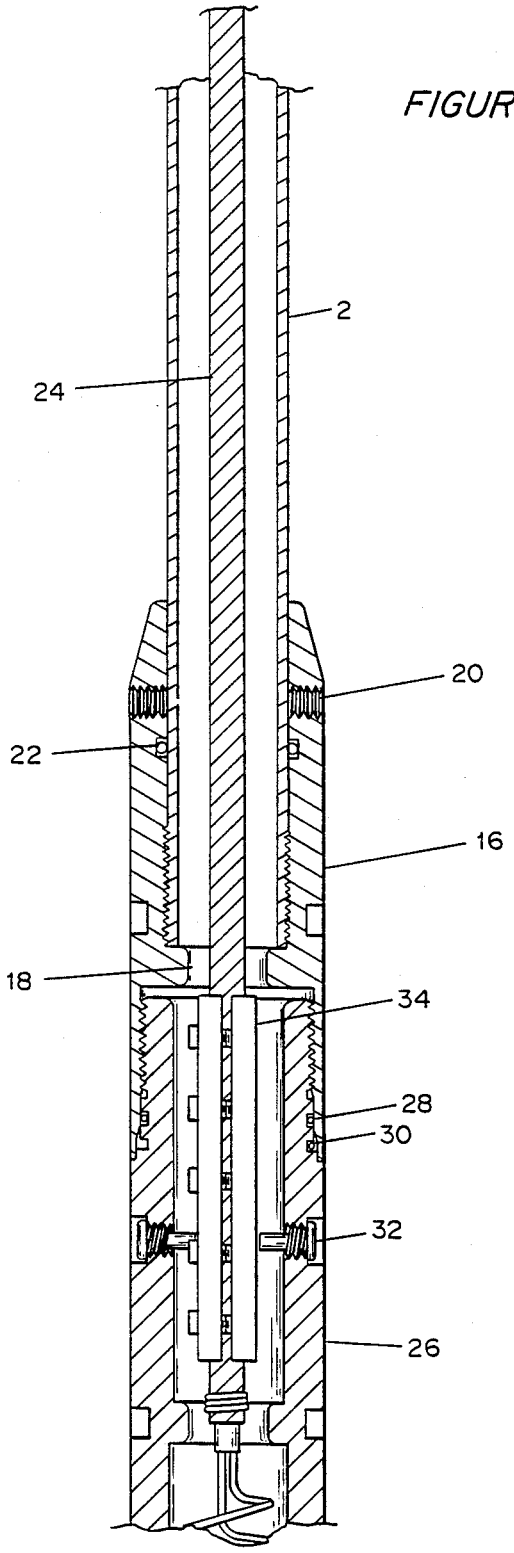
FIGS. 2A–2D are cross-sectional views illustrating the apparatus of the present invention.
Figure 2B:
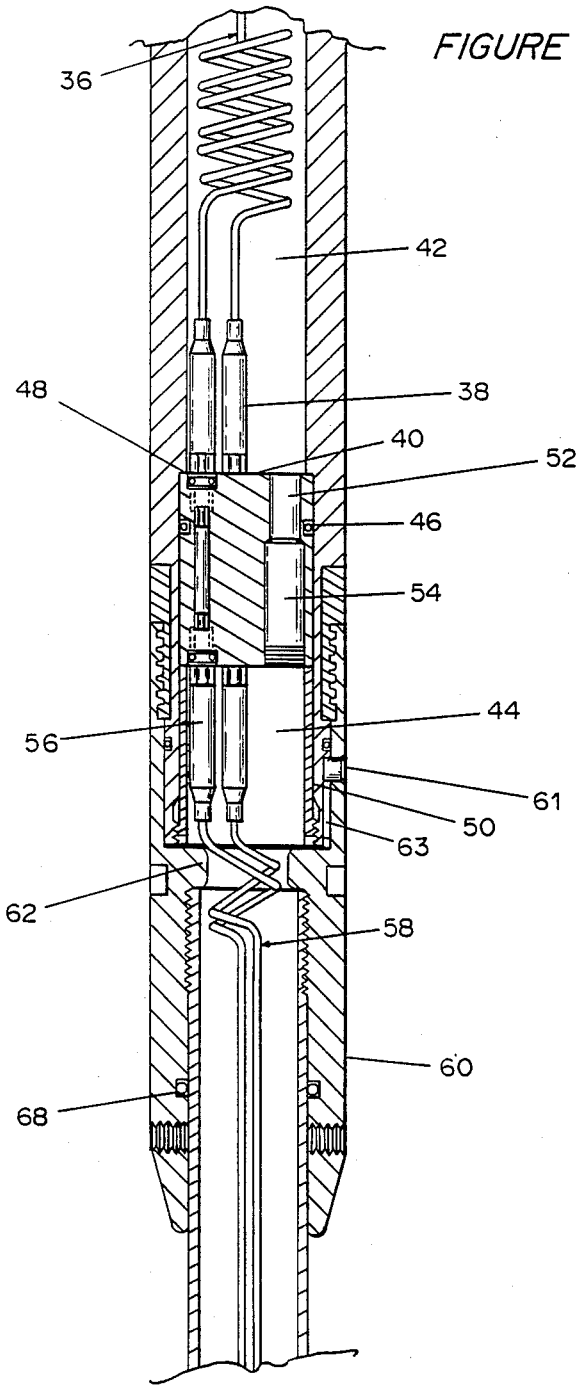
Figure 2C:
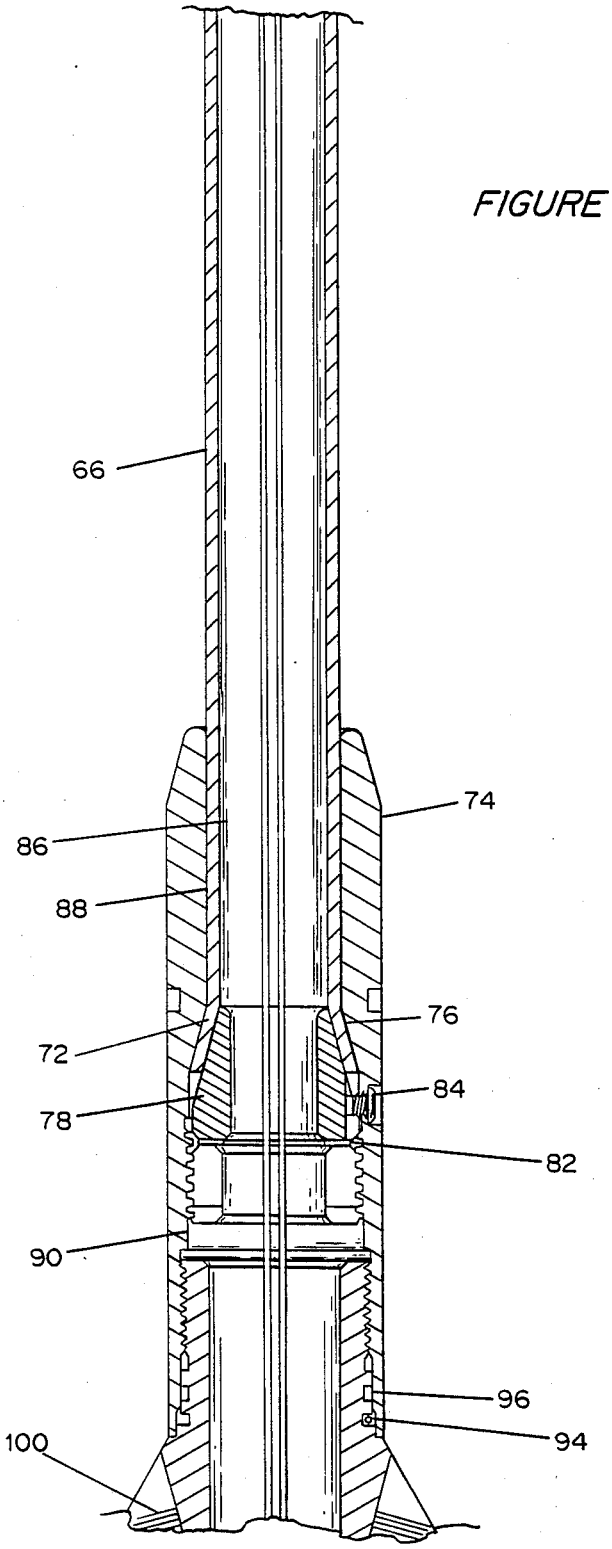
Figure 2D:
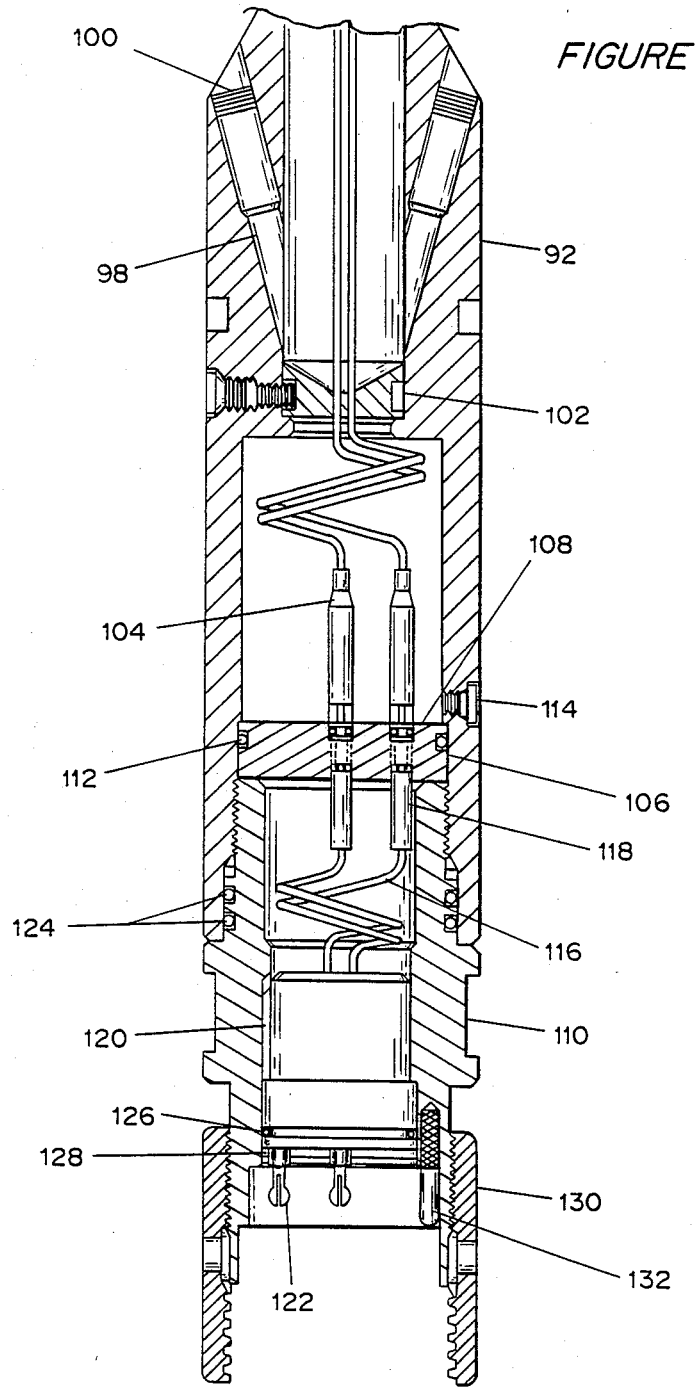

In FIG. 1 is shown a typical arrangement whereby coil tubing 2 is inserted into the bore hole 4 of an oil and gas well. This well is shown as having a deviated portion 6, and, while coil tubing finds its greatest use in deviated wells, neither the use of coil tubing nor the invention described herein is limited to deviated wells. The coil tubing 2 is contained on a reel 8 which is placed on the surface in a convenient location for insertion into the bore hole 4. The coil tubing 2 is run into the bore hole 4 through an injector assembly 10 in a manner known in the art, and a more detailed discussion of the manner in which coil tubing is deployed in the bore hole of a well can be found in U.S. Pat. No. 3,401,749, which is incorporated herein by reference. Attached to the distal (downhole) end of the coil tubing 2 is the coupling device 12, being an embodiment of the invention described herein, for connecting the coil tubing 2 to a wireline tool or a perforating gun or any other suitable downhole tool (together herein after referred to as "logging tool") 14.

The upper end of the coupling device 12, being the end at which connection of said device is made to the coil tubing 2, can be seen more clearly in FIG. 2. Coil tubing 2 is externally screw threaded at its distal (downhole) end, and, when coaxially received within top sleeve 16 thereby becomes threadedly attached to top sleeve 16. [Top sleeve 16 has an internal bore, having a reduced diameter shoulder 18. The surface of the bottom end of the coil tubing 2 is seated on shoulder 18 when coil tubing 2 is attached to top sleeve 16.] Set screws 20 prevent the coil tubing 2 from backing out of top sleeve 16 or rotating therein; and O-ring 22 provides an occlusive seal between them. Cable 24 passes out of the coil tubing 2 into flow control sub 26.

Flow control sub 26 is threadedly attached to top sleeve 16, and O-ring 28 provides an occlusive seal therebetween. Spiral pin 30 prevents flow control sub 26 from backing out of top sleeve 16. Flow control sub 26 has an internal bore into which cable 24 passes from out of the coil tubing 2. Anti-rotation screws 32 are set into wireline clamp 34 to prevent cable 24 and the coupling device 12 from rotating with respect to each other. Below clamp 34, electrical conductors 36 emerge from cable 24, each of which conductors 36 terminates in an electrical contact pin 38. Contact pins 38 are inserted into electrical plugs in flow control bulkhead 40. It should be recognized that while only two conductors 36 are illustrated, cable 24 may contain any number of electrical conductors.

Flow control bulkhead 40 divides and seals off an upper portion 42 of the internal bore of flow control sub 26 from a lower portion 44 thereof. O-ring 46 provides a fluid-tight seal at such location. The surface of one end of flow control bulkhead 40 abuts a shoulder 48 in the wall of the internal bore of flow control sub 26. Flow control bulkhead 40 is held in place against shoulder 48 by lock ring 50 which is coaxially received within the lower portion 44 of the internal bore of flow control sub 26. Lock ring 50, being externally screw threaded, engages threads on the wall of the lower portion 44 of the internal bore of flow control sub 26; and giving lock ring 50 maximum advancement along the set of threads holds flow control bulkhead 40 against shoulder 48. Flow control bulkhead 40 contains a bore 52 which is longitudinally parallel to the internal bore of flow control sub 26, and pilot valves 54 allow fluid flow through channel 52 only in one direction from coil tubing 2 toward the bottom of the bore hole 4. Conductors within flow control bulkhead 40 electrically connect contact pins 38 and contact pins 56.

Conductors 58 emerge from contact pins 56 and pass from flow control sub 26 into bottom sleeve 60. Bottom sleeve 60 is a cylindrical member with an internal bore which is partially occluded by shoulder 62. Flow control sub 26 is coaxially received within bottom sleeve 60, and the surface of the bottom end of flow control sub 26 abuts on shoulder 62. Flow control sub 26 is threadably attached to bottom sleeve 60. Pin 61 in slot 63 prevents rotation of the members relative to one another. Below shoulder 62, release sub 66 is coaxially received within bottom sleeve 60, and they are threadedly attached. O-ring 68 provides an occlusive seal at such location, and set screws 70 prevent release sub 66 from backing out of bottom sleeve 60, or rotating therein. The surface of the top end of release sub 66 abuts shoulder 62.

Release sub 66, typically a length of coil tubing, has a cylinder shape over most of its length, but flares into a bell shape at its lower end forming a skirt 72, which is coaxially received into locking sub 74. Locking sub 74 has in internal bore for said receipt of said skirt 72 of release sub 66, and the wall of said internal bore is beveled to provide a chamfer 76 of complimentary shape to skirt 72. Ferrule 78 is coaxially received inside skirt 72, and is held therein by nut 80. Lock washer 82 is disposed between nut 80 and ferrule 78. Nut 80 is externally screw threaded, and engages threads on the internal bore of locking sub 74. Set screw 84 prevents the rotation of ferrule 78 within release sub 66 and locking sub 74. A portion 86 of release sub 66 above skirt 72 is coaxially disposed within neck 88 of locking sub 74.

The internal bore of locking sub 74 is partially occluded by shoulder 90. The surface of the top end of cable head body member 92, which is coaxially received with the lower portion of locking sub 74 and is threadedly attached thereto, abuts shoulder 90. Spiral pin 94 prevents cable head body member 92 from backing out of locking sub 74, and O-ring 96 provides an occlusive seal therebetween. Cable head body member 92 has an internal bore, and flow ports 98 provide fluid communication between the internal bore and the bore hole 4 of the well. Pilot valves 100, one in each of said flow ports 98, prevent the flow of fluid from the bore hole 4 into the cable head body member 92, but allow fluid to flow from cable head body member 92 out into the bore hole 4. Flow diverter 102 directs any fluid pumped down through the coil tubing 2 out through flow ports 98 into the bore hole 4.

Electrical conductors 58 pass out of bottom sleeve 60 and into and through release sub 66, locking sub 74 and cable head body member 92, consecutively. In cable head body member 92, conductors 58 terminate in contact pins 104, which are inserted into pressure bulkhead 106, which is held against shoulder 108 by bottom sub 110 within cable head body member 92. O-ring 112 provides an occlusive seal between pressure bulkhead 106 and cable head body member 92. Grease fittings 114 allow the injection of grease into the portion of cable head body member 92 between flow diverter 102 and pressure bulkhead 106 to protect conductors 58 and contact pins 104 from conductive fluids. Conductors 116 emerge from contact pins 118 and pass to conductor block 120, from which electrical pins 112 extend, within bottom sub 110.

Bottom sub 110 is threadedly attached to cable head body member 92, and O-rings 124 provide an occlusive seal therebetween. O-ring 126 provides an occlusive seal between conductor block 120 and bottom sub 110.

Conductor block 120 is held in place by snap ring 128, which is inserted into a circumferential groove in the wall of bottom sub 110. Make-up collar 130, which is threadedly attached to bottom sub 110, provides the set of threads necessary to attach a logging tool (not shown) to the coupling device 12, and alignment key 132 assures that proper circuitry is maintained when contact pins 122 are inserted into receptacles on the tool 14.

In field operations using the coupling device 12 which is the subject of this invention, the coil tubing 2, coupling device 12 and logging tool 14 are lowered into the well. Fluid can be run down from the surface through the coil tubing 2 by means of a pump typical in the art, through and out flow ports 98, pilot valves 100, to help drive the logging tool 14 down into the bore hole 4. The fluid exiting from flow ports 98 allows the interior of the coil tubing 2 and the coupling device 12 to reach pressure equilibrium with the contents of the bore hole 4. Although, for fluid to be expelled from flow ports 98, the pressure inside coil tubing 2 and coupling device 12 must be slightly higher than the pressure in the bore hole 4. Pilot valves 100 are preferably chosen so that an approximate pressure differential of five psi is sufficient to cause fluid to flow out of coupling device 12 into bore hole 4. At such time as pumping from the surface, and consequently fluid flow out of flow ports 98, is stopped, the pressure inside coupling device 12 and the pressure in the bore hole 4 are substantially equal.

Provided the field operation proceeds without complication, the coupling device 12 functions as just that—a mechanical joinder of the coil tubing 2 and the logging tool 14. However, should a sudden increase, or "spike", of pressure occur in the bore hole 4, pilot valves 100 will prevent any backflow of fluid into the coupling device 12 and coil tubing 2. Such inflow of fluid at elevated pressure, should it occur, could easily rupture the coil tubing 2 or damage the cable 24 or electrical conductors. Pilot valves 100 are preferably chosen so that they will prevent the intrusion of fluid up to the point where pressure in the bore hole 4 exceeds that in coupling device 12 by approximately 5,000 psi. Additionally, when the fluid inside the coil tubing 2 and the fluid in the bore hole 4 are at substantially the same pressure, a pressure spike in the bore hole 4 subjects the coil tubing 2 to a much lower pressure differential than if the coil tubing 2 were dry or contained fluid at atmospheric pressure. This is important because a pressure differential in the bore hole 4 of much over 5,000 psi will likely crush the coil tubing 2.

Another feature is that the coupling device 12 provides a controlled "pull-out". As has been stated above, pull-outs for use with wireline tools are known in the art. However, where a wireline is run down through coil tubing, employing a conventional wireline pull-out would, upon its separation from the tool, leave the interior of the coil tubing exposed to the inflow of bore hole fluids, with the undesired consequences stated above. Employment of the pull-out contained in the coupling device 12 described herein will, on the contrary prevent the intrusion of bore hole fluids into the coil tubing 2.

The tightening of nut 80 causes ferrule 78 to compress the skirt 72 of release sub 66 against the chamfer 76 of locking sub 74. The only way to pull release sub 66 out of locking sub 74 is to pull release sub 66 with enough force to deform skirt 72 sufficiently to allow its passage through the neck 88 of locking sub 74. The amount of tension on the coil tubing 2 necessary to accomplish such task can be regulated by the degree to which nut 80 is tightened against ferrule 78 and the angle of flare of chamfer 76 and skirt 72. The tighter nut 80 is driven against ferrule 78, the tighter ferrule 78 compresses skirt 72 against chamfer 76, and the greater the force of friction at the interface of the exterior surface of skirt 72 and the interior surface of chamfer 76. Friction is also present at the interface of the interior surface of skirt 72 and the top surface of ferrule 78. The tension required to pull skirt 72 through neck 88 of locking sub 74 is therefore governed not only by the pressure of ferrule 78 normal to the interface of skirt 72 and chamfer 76, but also by the angle of flare, which determines the extent to which skirt 72 must be deformed to pass through neck 88.

The coupling device 12 described herein will, consequently, allow a range of choice as to the amount of tension needed to achieve the pull-out and separate the coil tubing 2 from the logging tool 14. When the coil tubing 2 has been separated from the logging tool 14, bore hole fluid will surge into the opening created out of the bottom of release sub 66. The fluid will advance no further than pilot valve 54, however, and the interior of the coil tubing 2 and all apparatus therein will be protected from the intrusion of bore hole fluid.

Many modifications and variations besides those specifically mentioned herein may be made in the techniques and structure described herein and depicted in the accompanying drawings without departing substantially from the concept of the present invention. Accordingly, it should be clearly understood that the forms of the invention described and illustrated herein are exemplary only, and are not intended as limitations on the scope of the present invention.

The embodiments of this invention in which an exclusive property or privilege is claimed are defined as follows:

1. An apparatus for coupling a tool to a string of coil tubing in a bore hole, comprising:

a tubular lower housing attached to said tool;

a tubular upper housing, having a first end coaxially received within said lower housing, and having a second end attached to said string of coil tubing; and means, located within said upper and lower housings, for compressing said first end of said upper housing against said lower housing.

2. The apparatus of claim 1 further comprising means, located within said lower housing, for regulating the extent to which said upper housing is compressed against said lower housing.

3. The apparatus of claim 1 wherein said means for compressing said upper housing against said lower housing comprises a ferrule.

4. An apparatus for decoupling a tool from a string of coil tubing in a bore hole, comprising:

a tubular lower housing attached to said tool;

a tubular upper housing, having a first end received within said lower housing and retained therein by friction, said tubular upper housing also having a second end attached to said string of coil tubing; and means, located within said lower housing, for deforming said first end of said upper housing upon the decoupling of said tool from said string of coil tubing by applying tension to the string of coil tubing.

5. The apparatus of claim 4 wherein said tool is decoupled from said coil tubing in response to tension applied to said coil tubing.

6. The apparatus of claim 4 wherein said upper housing is deformed in response to tension applied to said coil tubing.

7. The apparatus of claim 6 further comprising means, located within said upper and lower housings, for regulating the amount of tension required for deforming said upper housing.

8. The apparatus of claim 4 wherein said upper housing is withdrawn from said lower housing upon the decoupling of said tool from said string of coil tubing.

9. The apparatus of claim 8 further comprising means, located within said upper and lower housings, for regulating the friction between said upper housing with said lower housing upon the withdrawal of said upper housing from said lower housing.

10. The apparatus of claim 9 wherein said means for regulating friction comprise a ferrule and a lock nut.

11. The apparatus of claim 4 wherein said lower housing comprises:

a cylindrical member having an internal bore; and a chamfer in said internal bore.

12. The apparatus of claim 4 further comprising:

means, located in said lower housing, for communicating fluid from said coil tubing into said bore hole; and means for diverting said fluid from coil tubing into said fluid communicating means.

13. The apparatus of claim 12 wherein said fluid communicating means restrict entry of fluid from said bore hole into said lower housing.

14. A method for coupling a tool to a string of coil tubing disposed within a bore hole, comprising the steps of:

attaching an end of a lower housing to said tool;

attaching an end of an upper housing to said string of coil tubing; and axially receiving an opposite end of said upper housing in an opposite end of said lower housing; and detachably coupling said upper housing within said lower housing by way of an adjustable pressure fitting, compressing the opposite end of said upper housing against the opposite end of said lower housing by a pressure applying means positioned within said lower housing.

15. A method for decoupling a tool from a string of coil tubing disoposed within a bore hole, comprisinig the steps of:

attaching a lower housing to said tool;

attaching an upper housing to said string of coil tubing; and pressure coupling an end of said upper housing coaxially within said lower housing, decoupling the tool from the coil tubing by applying a tension force to the coil tubing thereby deforming the end of said upper housing and allowing the upper housing to be withdrawn from the lower housing.

16. The method of claim 15 further comprising the step of:

adjusting the amount of pressure applied to the coupling retaining the upper housing within said lower housing in accordance with a desired amount of tension on said coil tubing required to deform and withdraw said upper housing from said lower housing.

* * * * *